US007901245B2

(12) United States Patent
Scholler et al.

(10) Patent No.: US 7,901,245 B2
(45) Date of Patent: Mar. 8, 2011

(54) ANGLE CONNECTOR FEATURING A VARIABLE DIRECTION OF EXTENSION

(75) Inventors: Johann Scholler, Deggendorf (DE); Sonja Fredl, Deggendorf (DE)

(73) Assignee: CONINVERS GmbH, Herrenberg (DE)

( * ) Notice: Subject to any disclaimer, the term of this patent is extended or adjusted under 35 U.S.C. 154(b) by 140 days.

(21) Appl. No.: 12/375,698

(22) PCT Filed: Feb. 4, 2008

(86) PCT No.: PCT/DE2008/000196
§ 371 (c)(1),
(2), (4) Date: Jan. 30, 2009

(87) PCT Pub. No.: WO2008/092444
PCT Pub. Date: Aug. 7, 2008

(65) Prior Publication Data

US 2009/0305558 A1 Dec. 10, 2009

(30) Foreign Application Priority Data

Feb. 2, 2007 (DE) ..... 20 2007 001 523 U

(51) Int. Cl.
*H01R 13/60* (2006.01)

(52) U.S. Cl. ..... 439/567; 439/534; 439/902

(58) Field of Classification Search ..... 439/564, 439/569, 534, 902, 321, 954
See application file for complete search history.

(56) References Cited

U.S. PATENT DOCUMENTS 4,726,782 A * 2/1988 Hager et al. ..... 439/321
4,741,706 A * 5/1988 Takeda et al. ..... 439/318
4,820,184 A * 4/1989 Brandes ..... 439/321
5,035,640 A * 7/1991 Drogo ..... 439/321
7,625,226 B1 * 12/2009 Gastineau ..... 439/321

FOREIGN PATENT DOCUMENTS

| | | |
|---|---|---|
| DE | 195 20 544 | 6/1996 |
| DE | 298 13 455 | 12/1999 |
| EP | 1 465 293 | 10/2004 |

OTHER PUBLICATIONS

International Search Report for corresponding PCT Application No. PCT/DE2008/000196 mailed, Sep. 1, 2008.

* cited by examiner

*Primary Examiner* — Hien Vu
(74) *Attorney, Agent, or Firm* — Renner, Otto, Boisselle & Sklar, LLP

(57) ABSTRACT

The invention relates to an angle connector that is to be mounted on a unit housing and comprises a plug housing and a housing flange which partially extends over the plug housing and can be fastened in a rotationally fixed manner to the unit housing. The plug housing is rotatably fastened to the housing flange and can be twisted, using rotational resistance, relative to the housing flange in order to define the direction of extension. The plug housing of the disclosed angle connector is rotatably mounted on the housing flange by means of an elastic sleeve which is rotatably accommodated inside an annular front recess of the plug housing or housing flange and engages in a rotationally fixed manner with the respective associated housing flange or plug housing. In the area where the plug housing and the housing flange overlap, the plug housing and the housing flange are positively interconnected in at least some sections in an axial and radial direction while being non-positively interconnected in the circumferential direction by means of the sleeve.

5 Claims, 3 Drawing Sheets

ANGLE CONNECTOR FEATURING A VARIABLE DIRECTION OF EXTENSION

TECHNICAL FIELD OF INVENTION

The invention relates to an angle connector that is to be mounted on a unit housing and comprises a plug housing and a housing flange which partially extends over the plug housing and can be fastened in a rotationally fixed manner to the unit housing. The plug housing is rotatably fastened to the housing flange and can be twisted, using rotational resistance, relative to the housing flange in order to define the direction of extension.

DISCUSSION OF RELATED ART

Such angle connectors are used for example for connecting motors. The angle connectors are to be easy to install and their direction of extension is to be variable; once set, a direction of extension cannot change unintentionally and by itself under the influence of vibrations that are usually unavoidable in mechanically driven devices. As a consequence, the setting of the direction of extension must not be possible without the influence of a certain torque so that, after setting, the plug housing that determines the direction of extension of the angle connector remains in its position relative to the housing flange.

From DE 298 13 455 U1, an angle connector according to the preamble is known where a click-stop device is provided for fixing a plug housing and a housing flange in a selectably twisted position relative to each other. The click-stop device is located in the area of mutual overlap of the plug housing and the housing flange, with the locking process taking place there by means of at least two flat surfaces in contact with each other between the parts to be locked together and the click-stop device in such a way that a number of fixed surfaces on the outer circumference of the housing flange interact with a corresponding number of surfaces on the inner circumference of the plug housing that are radially movable under spring load. The surfaces that are movable against a spring load are formed by leaf spring segments that, in form of individual parts or as composite, are carried by the plug housing.

The leaf spring segments of the patented design described above are delicate parts that are costly to produce and difficult to handle which, on the one hand, requires a disproportionately high production effort, and, on the other hand, leads to not inconsiderable difficulties in assembling the angle connector.

With reference to this prior art, the invention addresses the problem of proposing an angle connector with a variable direction of extension that can be produced with the lowest possible effort, can be set in almost any direction of extension without tools, and, at the same time, is sufficiently secure from unintentional setting changes.

SUMMARY OF THE INVENTION

According to the invention, this problem is solved by an angle connector with the characteristics of claim 1. Additional advantageous implementations are given in the subclaims.

In the angle connector according to the invention, the plug housing is rotatably mounted on the housing flange by means of an elastic sleeve which is rotatably accommodated inside an annular front recess of the plug housing or housing flange and engages in a rotationally fixed manner with the respective associated housing flange or plug housing. In the area where the plug housing and the housing flange overlap, the plug housing and the housing flange are positively interconnected in at least some sections in an axial and radial direction while being non-positively interconnected in the circumferential direction by means of the sleeve. Specifically, the sleeve has a cylindrical shape that is matched to the diameter of the plug housing and the length of the housing flange, and can be made from steel, plastic, or other materials that are suitable for spring elements.

The axial and radial positive interconnection of the plug housing and the housing flange in at least some sections is produced by the interlocking engagement of the two parts with little axial or radial play, with the plug housing rotatably fixed in the housing flange. In the radial direction, circumferential surfaces of the housing flange and of the plug housing are in contact with each other. For rotatable fixing in the axial direction, interacting locking elements are provided on the plug housing and the housing flange, for example in the shape of a radially extending collar that is associated with a countersurface, and/or as radially extending protrusions, preferably with spring action, that positively engage one or several groove-type recesses. In this way, the plug housing cannot detach itself from the housing flange unintentionally.

In the circumferential direction, the plug housing is non-positively connected with the housing flange via the elastic sleeve. The sleeve is located between the plug housing and the housing flange and engages the housing flange or the plug housing in a rotationally fixed manner. Via a part of its inner and/or outer circumferential surface and/or the associated front surface, the sleeve is acted upon by the plug housing or the housing flange in which it is rotatably accommodated in an annular recess, and restrains the plug housing by friction when the plug housing is rotated relative to the housing flange.

When the direction of extension of the angle connector is being set, the sleeve is reversibly elastically deformed in the axial and/or radial direction. By means of the shape of the frontal annular recess of the plug housing or of the housing flange which the elastic sleeve engages rotatably, it is possible to set the rotational resistance in sections or uniformly over the entire circumference of the housing flange. In addition, it is also possible to influence the rotational resistance by the geometry of the sleeve or the selection of suitable materials for the sleeve.

Advantageously, the elastic sleeve rests radially deformed in a wavy pattern and in pre-tensioned state in the annular recess that may have the form of a frontal annular groove or of a frontal annular step. For pre-tensioning, on at least one circumferential surface on the recess, several cams are provided that are staggered relative to each other especially in the circumferential direction and have a deforming effect on the sleeve. The number of the undulations of the sleeve is determined by the number of the cams of the circumferential surface. Depending on the height of the cams in relation to the circumferential surface, the distance of the cams from each other, and their arrangement on one or two circumferential surfaces of the annular recess, the rotational resistance of the angle connector will vary.

Preferably, during the rotary motion of the plug housing in relation to the plug flange, the sleeve is dynamically elastically deformable in the radial direction. When the plug housing of the angle connector is rotated, the elastic sleeve is dynamically deformed in the radial direction along its circumference, moving in the direction of rotation of the plug housing, with a frictional force that acts tangentially in relation to the sleeve to be overcome.

In a preferred embodiment of the invention, the sleeve is supported with radial play in the housing flange or the plug housing that the sleeve engages in a rotationally fixed manner. This makes it possible for the sleeve to deform uniformly over its entire length when it is dynamically radially deflected section by section so that the deformation can progress without problem in a wave-type pattern along the circumference of the sleeve.

In an advantageous implementation of the angle connector according to the invention, the sleeve is made of a synthetic material. All casting and drawing methods known to a person skilled in the art may be used for the production. This permits low material costs and a cost-efficient manufacture for mass production.

In one embodiment, the sleeve is coated. The coating is specifically intended for minimizing friction, and may be applied with all common industrial methods that are suitable for surface coating.

Below, the invention is explained in detail with reference to an embodiment shown in the drawing. Additional characteristics of the invention follow from the following description of the embodiment of the invention in conjunction with the claims and the attached drawing. In different implementations of the invention, the individual characteristics may be implemented either by themselves or in combinations of several.

DETAILED DESCRIPTION OF THE INVENTION

Figure 1:
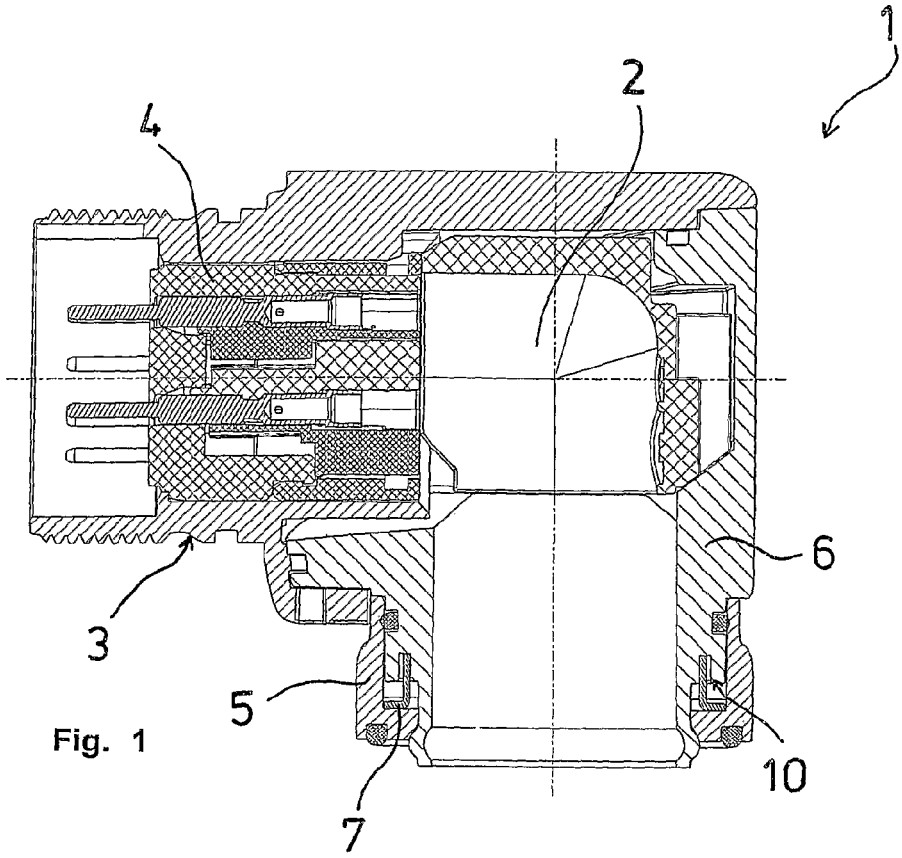
FIG. 1 shows a longitudinal section through a first angle connector according to the invention, with a contact carrier accommodated in a plug housing, and with a housing flange that overlaps a housing flange socket.
Figure 2:
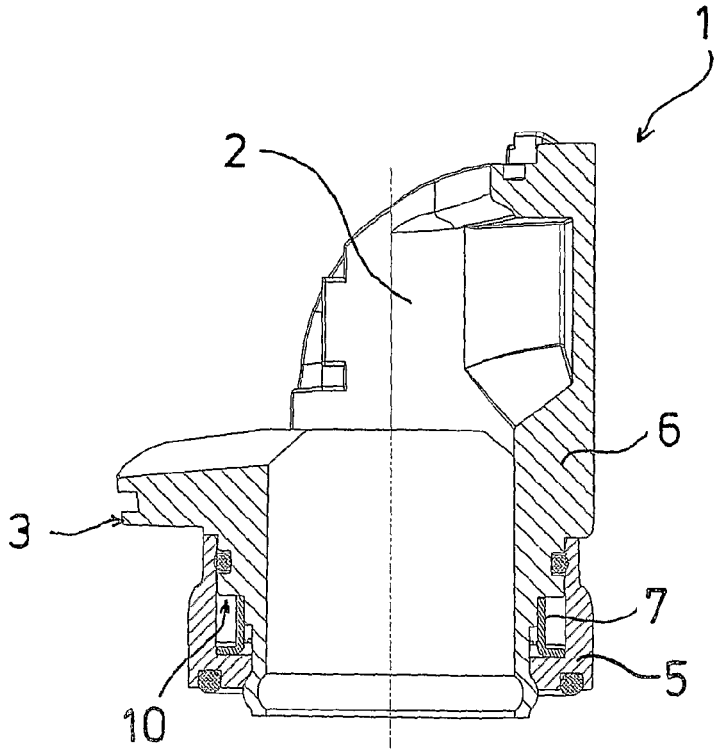
FIG. 2 shows a longitudinal section through a second angle connector according to the invention.

FIGS. 1, 2 show angle connectors 1 according to the invention with a plug section 2 that has a contact carrier 4 accommodated in a plug housing 3. In addition, the angle connector 1 has a housing flange 5 that overlaps a housing flange socket 6 of the plug housing 3 on the outside. By means of the housing flange socket 6, the plug housing 3 is rotatably mounted on the housing flange 5. The attachment of the plug housing 3 or of the housing flange 6 may be accomplished, for example, with a locking ring that is not shown in the drawing.

Figure 5:
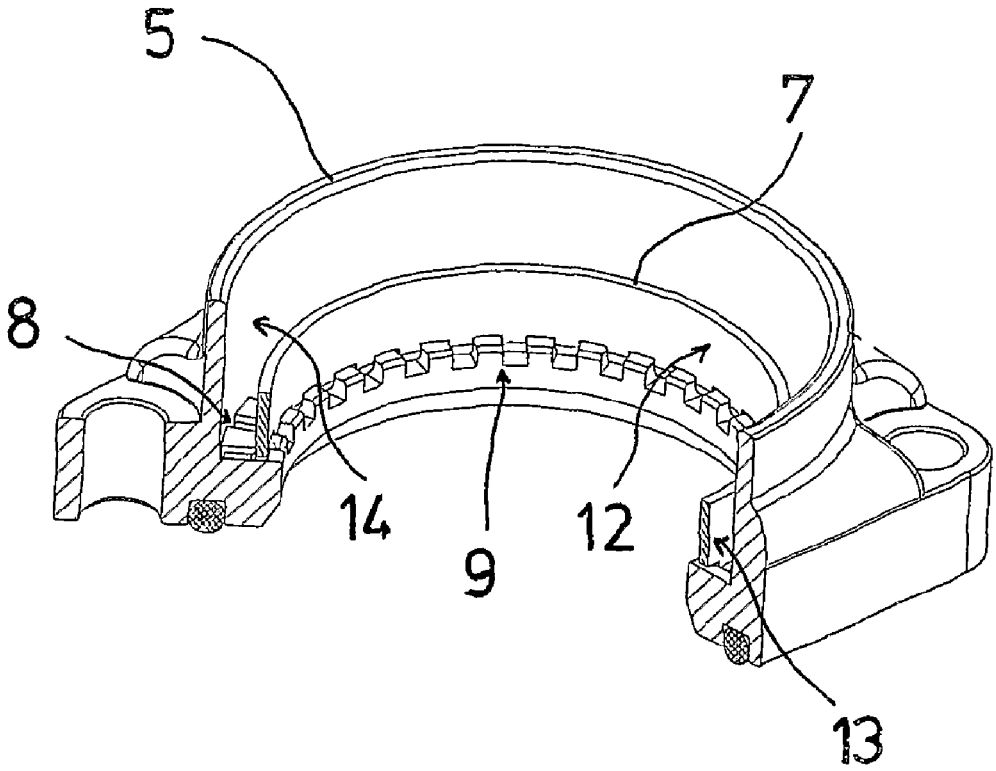
FIG. 5 shows a perspective section view through the housing flange with the sleeve installed according to FIGS. 1, 2.

Between the housing flange 5 and the housing flange socket 6, an elastic sleeve 7 is located frontally with which the plug housing 3 supports itself on the housing flange 5. The sleeve 7 engages the housing flange 5 in a rotationally fixed manner. For this purpose, as can be seen from FIG. 5, on the face side of the sleeve 7 that is associated with the housing flange 5, teeth 8 are provided that engage with play a toothed rim 9 of the housing flange 5. The teeth 8 may extend in the longitudinal direction of, and/or transversely to a virtual longitudinal axis of the sleeve 7. In the implementation shown in the drawing, the teeth 8 are bent at an angle of 90 degrees. In the longitudinal direction of the sleeve 7, they protrude from the sleeve 7 and run in an axial direction of the sleeve 7 and the housing flange 5 in front of the bending point, and in a radial direction of the sleeve 7 and the housing flange 5 behind the bending point.

Figure 3:
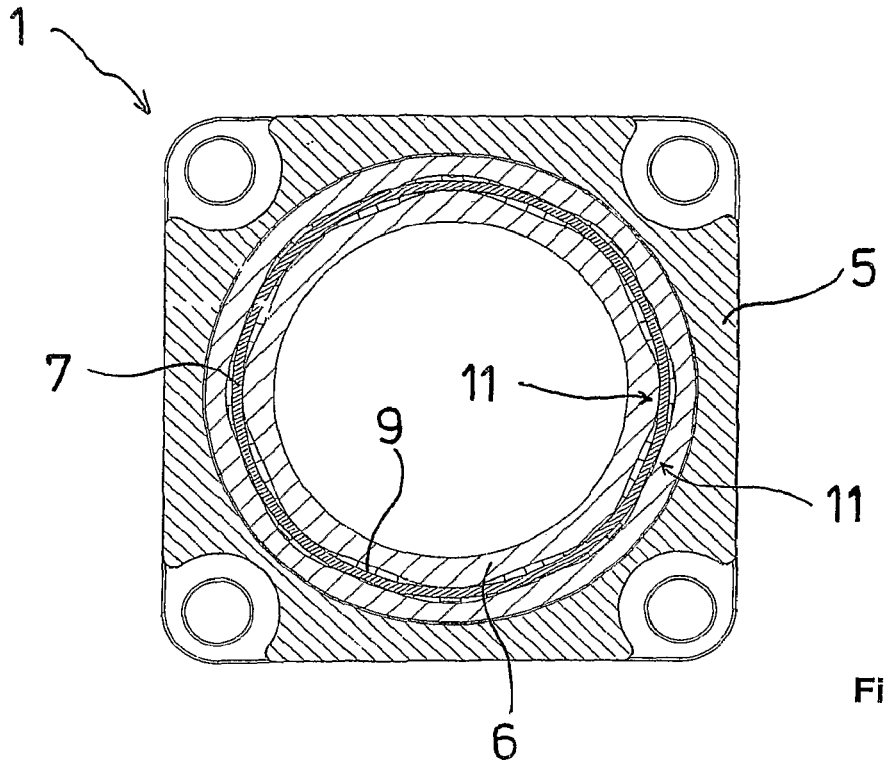
FIG. 3 shows a cross-sectional view through the angle connector from FIG. 1 in the area of the housing flange socket.
Figure 4:
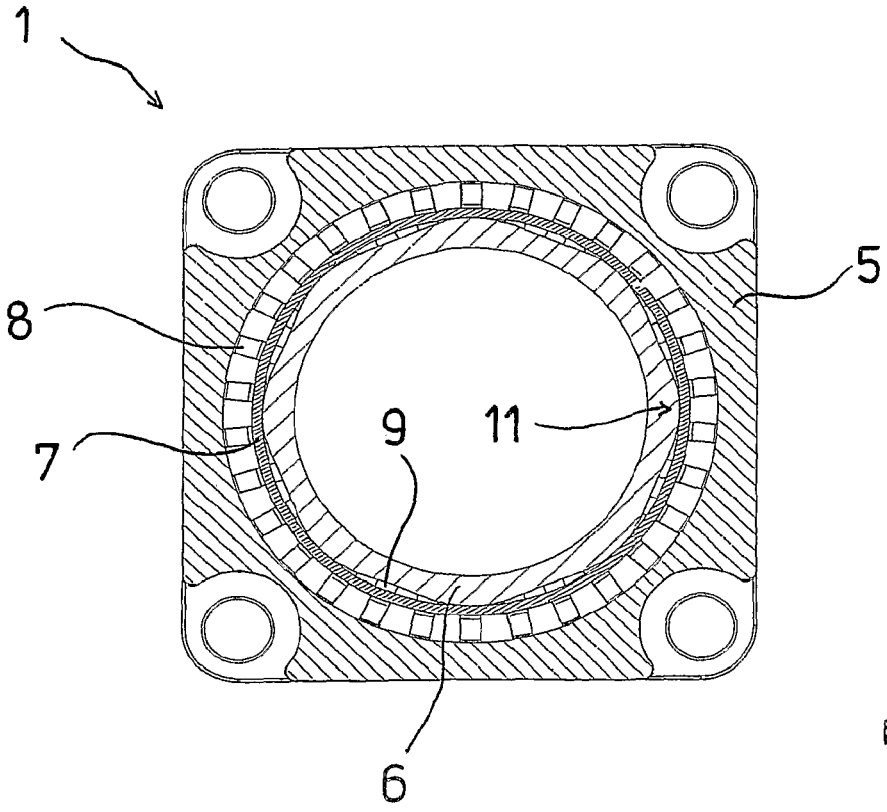
FIG. 4 shows a cross-sectional view through the angle connector from FIG. 2 in the area of the housing flange socket.

The sleeve 7 is rotatably accommodated in an annular front recess 10 of the plug housing 3. The recess 10 is provided on the housing flange socket 6, opposite the toothed rim 9 of the housing flange 5. In the first embodiment shown in the FIGS. 1, 3 it has the form of an annular groove, and in the second embodiment shown in the FIGS. 2, 4 it has the form of an annular step. The face side of the sleeve 7 associated with the housing flange socket 6 is flat and with its face side in contact with an annular surface of the recess 10.

In the area of their overlap, the housing flange socket 6 and the housing flange 5 are directly and positively interconnected in sections in the axial and the radial direction. In the circumferential direction of the housing flange socket 6, the sleeve 7 produces a non-positive connection between the housing flange socket 6 and the housing flange 5. For this purpose, the sleeve 7 contacts, pre-tensioned and with a wavy deformation, associated circumferential surfaces of the housing flange socket 6 and the housing flange 5. The deformation is produced by cams 11 that are arranged radially on the circumferential surfaces and are staggered in the circumferential direction in relation to each other. As can be seen from FIGS. 3, 4, in the embodiment where the recess 10 has the form of an annular step, the cams 11 act only upon an inner circumferential surface 12 of the sleeve 7; in the embodiment with the annular groove, they act upon the inner circumferential surface 12 and an outer circumferential surface 13 of the sleeve 7. The cams 11 cause the sleeve 7 to be elastically deformed in the radial direction so that the sleeve 7 has undulations running in the circumferential direction and is pressed against the housing flange 5 in the radial direction.

In the embodiments shown in the drawing, the sleeve 7 is rotatably accommodated in an annular recess 10 of the housing flange socket 6 and engages the housing flange 5 that overlaps the housing flange socket 6 in a rotationally fixed manner. In principle, it is also possible to rotatably accommodate the sleeve 7 in the housing flange 5 and to have it engage the housing flange socket 6 in a rotationally fixed manner. Also, deviating from the embodiments, the housing flange socket 6 may overlap the housing flange 5.

The invention claimed is:

1. An angle connector that is to be mounted on a unit housing and comprises a plug housing and a housing flange which partially extends over the plug housing, where the housing flange can be fastened in a rotationally fixed manner to the unit housing, and the plug housing is rotatably fastened to the housing flange and can be twisted, using rotational resistance, relative to the housing flange in order to define a direction of extension of the angle connector, wherein the plug housing is rotatably mounted on the housing flange by means of an elastic sleeve which has a cylindrical shape and is rotatably accommodated inside an annular front recess of the plug housing or housing flange and engages in a rotationally fixed manner with the respective associated housing flange or plug housing, where, in an area of overlap between the plug housing and the housing flange, the plug housing and the housing flange are positively interconnected in at least some sections in an axial and radial direction while being non-positively interconnected in a circumferential direction by means of the sleeve, wherein the annular front recess comprises a first circumferential surface and a second circumferential surface, wherein the second circumferential surface is part of the plug housing or the housing flange and encloses the first circumferential surface, said first circumferential surface having cams to deform the sleeve and wherein the sleeve rests in the annular front recess in a pre-tensioned state radially deformed in a wavy pattern by the cams and wherein the sleeve is dynamically elastically deformed in a radial direction during a rotary motion of the plug housing relative to the housing flange.

2. An angle connector according to claim 1, wherein the second circumferential surface comprises cams to additionally deform the sleeve, and wherein the cams of the first and the second circumferential surface are staggered in relation to each other.

3. An angle connector according to claim 1, wherein the sleeve is supported with radial clearance in the housing flange or the plug housing that the sleeve engages in a rotationally fixed manner.

4. An angle connector according claim 1, wherein the sleeve is made of a synthetic material.

5. An angle connector according to claim 1, wherein the sleeve is coated.

* * * * *